US005244278A

United States Patent [19]

Robitaille

[11] Patent Number: 5,244,278

[45] Date of Patent: Sep. 14, 1993

[54] COMBINATION TRAVEL POUCH AND ALL PURPOSE CLOTH ACCESSORY

[76] Inventor: Suzanne Robitaille, 225 Pease Rd., East Longmeadow, Mass. 01028

[21] Appl. No.: 865,286

[22] Filed: Apr. 8, 1992

[51] Int. Cl.[5] ..... B65D 30/00

[52] U.S. Cl. ..... 383/4; 2/49.2; 2/49.4

[58] Field of Search ..... 15/209.1, 210.1, 227; 383/127, 4; 5/417; 2/49 R, 50, 51, 52, 46, 48; 446/26, 27, 71–74

[56] References Cited

U.S. PATENT DOCUMENTS

| | | | |
|---|---|---|---|
| 2,389,596 | 11/1945 | Charnas et al. | 20/50 X |
| 2,530,746 | 11/1950 | Wetherby | 15/227 X |
| 3,010,110 | 11/1961 | Kirk | 2/49 R |
| 4,071,921 | 2/1978 | Jury | 15/227 |
| 4,154,323 | 5/1979 | Sneider | 5/417 X |
| 4,164,275 | 8/1979 | Davis | 383/4 X |
| 4,278,719 | 7/1981 | Samecki | 5/417 X |
| 4,634,618 | 1/1987 | Greer et al. | 383/127 X |
| 5,046,980 | 9/1991 | Tai et al. | 2/49 R X |

*Primary Examiner*—Bryon P. Gehman
*Attorney, Agent, or Firm*—Steven N. Fox

[57] ABSTRACT

Disclosed is an article of manufacture which, except for a zipper, is made from fabric textile and which functions as an all purpose travel accessory item. In one orientation, the article has an extension which can be unrolled from a pouch and used as a bib or lap napkin. The extension has an outer layer that is made of terry cloth and a bottom layer which is made of a nylon fabric. When the extension is unrolled, the pouch will be open and tends to catch any crumbs or liquids that may spill thereon. In another orientation, the pouch may be turned inside-out and can be completely closed without having to roll-up the extension therein.

9 Claims, 2 Drawing Sheets

COMBINATION TRAVEL POUCH AND ALL PURPOSE CLOTH ACCESSORY

FIELD OF THE INVENTION

The present invention relates generally to absorbent textile accessories and more particularly, to such accessories as are integrally combined with a travel pouch and which may be used in a variety of applications, such as for eating-on-the-run and for a variety of personal hygiene and toilet products.

BACKGROUND OF THE INVENTION

In the fast pace of modern Western society and particularly in the United States, it is not uncommon for automobile travelers and commuters to have a snack or quick breakfast while on the way to work. Similarly, parents traveling with a small baby will change the baby's diaper under a variety of circumstances. Additionally, no convenient and compact accessory uniformly adapted for such multi-purpose and diverse activities is presently available and the traveler is usually compelled to improvise by either using any available fabric or paper towel, or a specialized product to assist in such diverse activities.

For example, if one is eating or drinking a beverage in a moving vehicle, it is not uncommon for particles of food or crumbs to drop or the beverage to spill on their clothing which may and usually results in unsightly soils and stains. To minimize such soiling and staining of their clothing, many commuters have utilized various ways to protect their clothing against such spillage, such as by using sip-type mugs having a funnel-like cover or straw insert of the type frequently found in baby products. Bibs, of course, are also well known to protect small babies and young children from the droppings and spillage that invariably occur when eating. However, bibs for use by drivers who snack on-the-move have not generally found wide acceptance probably due to the ineffectiveness of such bibs to perform their intended function.

Bibs are usually composed of a plastic sheet material which has several disadvantages that tend to make such bibs unacceptable for use by the average adult. First, food particles and liquids have a marked tendency to drop from or run-off such plastic surfaces. Moreover, conventional bibs do not have a self-contained storage means and as such, after each use, the bib must generally be washed off and dried before storage. Although some disposable bibs are plastic coated paper, such bibs have only a limited capacity to absorb and retain liquid spills. Moreover, even textile fabric bibs adapted for reuse are usually made up of some type of textile fabric which will not prevent the liquid from penetrating through the fabric so as to provide adequate protection for the user's clothing.

Additionally, persons who go to concerts, sporting events, and on hiking expeditions, frequently end up sitting on wet or dirty seating areas. Other than the conventional stadium cushion, there is no multi-purpose article presently available which can be conveniently carried by a person on such occasions.

The principal object of the present invention is to provide an article of manufacture that can be easily used by commuters who eat-on-the-run and which is adapted during usage to catch and retain beverage spills and crumbs dropped thereon.

Another object of the present invention is to provide a multi-purpose article of manufacture that can be used by travelers for a wide range of applications such as personal hygiene, toiletry applications and as a mat to sit on when they encounter wet or dirty seating areas.

SUMMARY OF THE INVENTION

The present invention is an article of manufacture comprising a combination of a pouch and an integral multi-functional textile fabric extension which is absorbent yet moisture impervious. In one embodiment of the invention, the article may take the form of a bib-type protector in which the fabric extension can be easily unrolled from the pouch and after its use, rolled up with any crumbs or spills thereon and replaced in the pouch. The bib may also be used to hold peels, cores, wrappers or the like for future disposal and utensils for future washing. The pouch may then be fully closed and conveniently stored in a briefcase or other travel bag for future cleaning or reuse without concern that the debris will escape from the pouch. The pouch itself is moisture impervious thereby preventing the stored food or liquid from staining or smudging other articles of clothing or important papers also being carried by the user. In another embodiment, the pouch can be turned inside-out to provide a pouch which can be closed without having to first place the fabric extension therein. This feature allows the traveler to use the full capacity of the pouch to conveniently carry personal hygiene and toiletry items while also utilizing the fabric extension as a clean and soft surface for changing a baby's diaper or washing one's hands or face. Moreover, in this orientation, the article may be used as a mat to sit on so that the user's clothes will not come in contact with the wet and/or dirty seating area.

BRIEF DESCRIPTION OF THE DRAWINGS

The following detailed description will be more fully understood with reference to the accompanying drawings in which.

DETAILED DESCRIPTION OF THE PREFERRED EMBODIMENT

Figure 1:
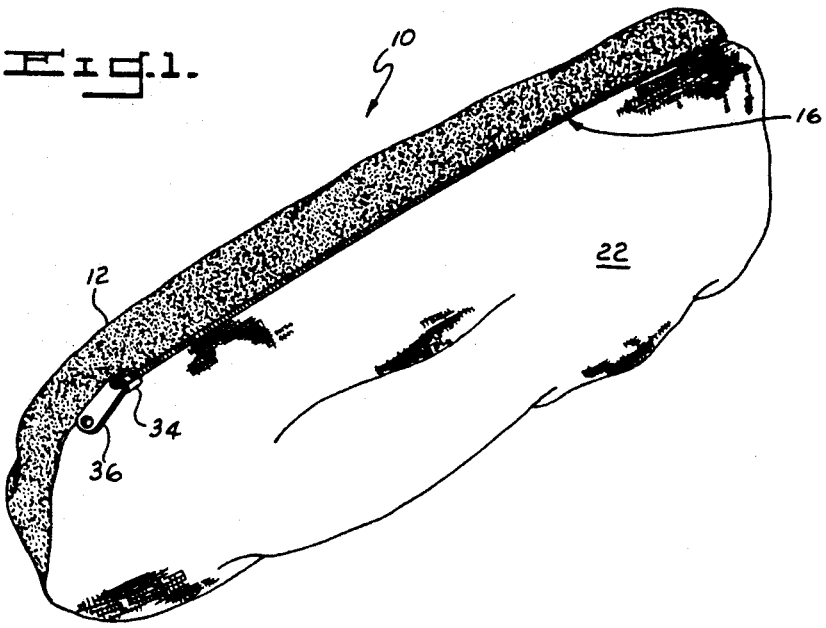
FIG. 1 is a perspective view showing a pouch of the type embodying the present invention in the closed condition.
Figure 2:
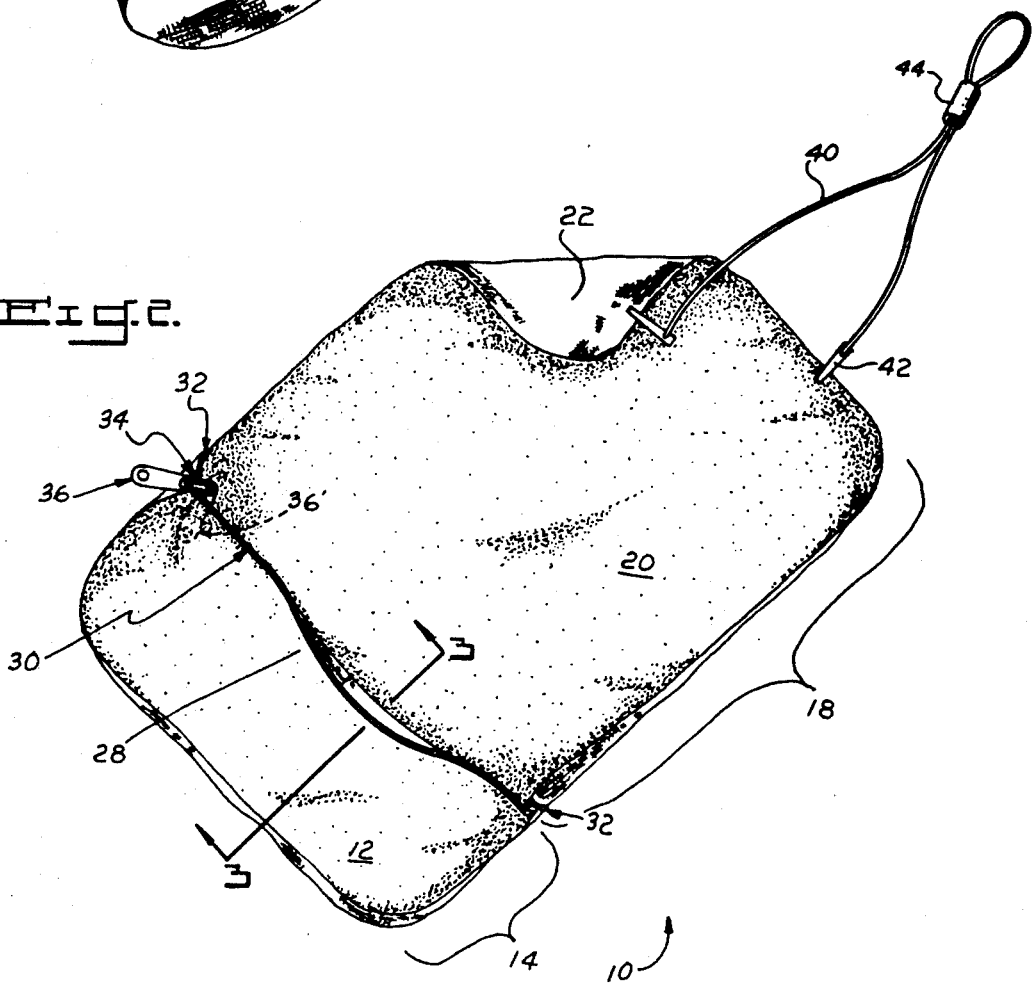
FIG. 2 is a perspective view showing the pouch in an open condition and with a textile fabric extension disposed in operative position in relation thereto.

A multi-purpose textile article of the type embodying this invention, is shown at 10 in FIG. 1 in a "closed" condition and in its "open" and "ready to use" condition in FIG. 2. The article 10 comprises a pouch portion 14 which may be opened or closed by a double sided slide fastener or zipper 16 which extends from end-to-end across the length of the pouch. As shown in FIG. 2, when the pouch 14 is "opened", a fabric extension 18 which is integral to the pouch may be removed and unrolled to provide a generally rectangular expanse of a towel-like fabric. The extension 18 is at least large enough to cover and protect the lap and/or chest of the user and to extend from one's chin for use as a bib-type protection for clothing or as a mat to sit on.

Figure 3:
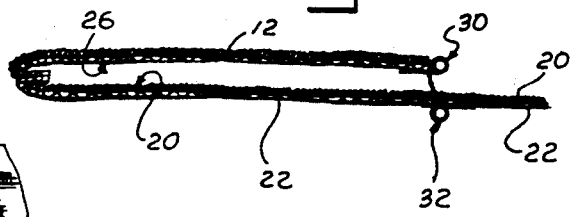
FIG. 3 is a cross-section view taken along line 3—3 of FIG. 2.

The extension 18 comprises a porous and highly absorbent outer layer 20, such as terry cloth, having characteristics of a face or bath towel. The terry cloth layer 20 serves to absorb liquid spills and to catch and hold small food particles and crumbs so that they will not readily be dislodged and fall from the surface. The extension also comprises an inner layer 22 which is preferably formed of a water resistant or impervious fabric, such as certain nylon fabric treated or coated to make it water proof. The nylon serves as a backing or barrier which will prevent the moisture absorbed by the terry cloth layer from penetrating through the extension 18 and coming in contact with the clothing of the user. The nylon fabric should also have a relatively rough surface texture and a certain degree of suppleness such that it will conform to, and tend to frictionally adhere to the surface of the user's garments. As shown by FIG. 3, pouch 14 on one side is formed by a combination of an outer layer 12 made of terry cloth and an inner layer 26 made of nylon. The back of the pouch 14 is formed as part of outer layer 20 and inner layer 22.

Fabrication of the present invention is best illustrated by FIG. 3, where a single layer of nylon fabric and a single layer of the same size terry cloth are superposed in edge-to-edge relation. These layers represent the heretofore described layers 20 and 22, respectively. Additionally, two narrower strips of terry cloth and nylon (composed of layers 12 and 26, respectively) are positioned adjacent the lower edges of the two larger layers. The four layers are preferably stitched together along their peripheral edges to form extension 18 and pouch or trough 14.

The free edge 28 of the pouch 14 is provided with a zipper tape portion 30 of the fastener 16. A corresponding zipper tape portion 32 is stitched across the inner layer 22 and is positioned in relation to zipper tape 30 so that they may be engaged by a double sided slider 34 and pull tabs 36 and 36' (FIG. 2) to close the pouch when extension 18 is rolled therein. The zipper tape may be applied before or after stitching of the four layers. Note that in the orientation of FIGS. 2 and 3, pull tab 36 is used to close the pouch 14 after the extension 18 has been placed therein. As will be described more fully herein, in the orientation of FIGS. 4 and 5, pull tab 36' is used to close a pocket 38.

When the article is used as a bib-type protector, a cord 40 or similar piece may be fastened to the upper edge of extension 18 by clips 42. Cord 40 is adapted to be fitted around the neck of a person and in conjunction with a slide member 44, may be adjusted as desirable for proper fit.

In the "open" configuration of FIGS. 2 and 3, the article may be used a bib and the pouch 14 serves in the nature of an upwardly opening trough which tends to catch any food particles or liquids which are not captured and retained by the terry cloth layer 20 of extension 18 or to hold snacks or other food articles. After its use, the extension 18 and associated food particles may be rolled-up and the pouch may be closed and conveniently stored away. Alteratively, when the article is closed, it may be used as a lower back or lumbar support or may serve while driving or resting as a neck or head support pillow.

Figure 5:
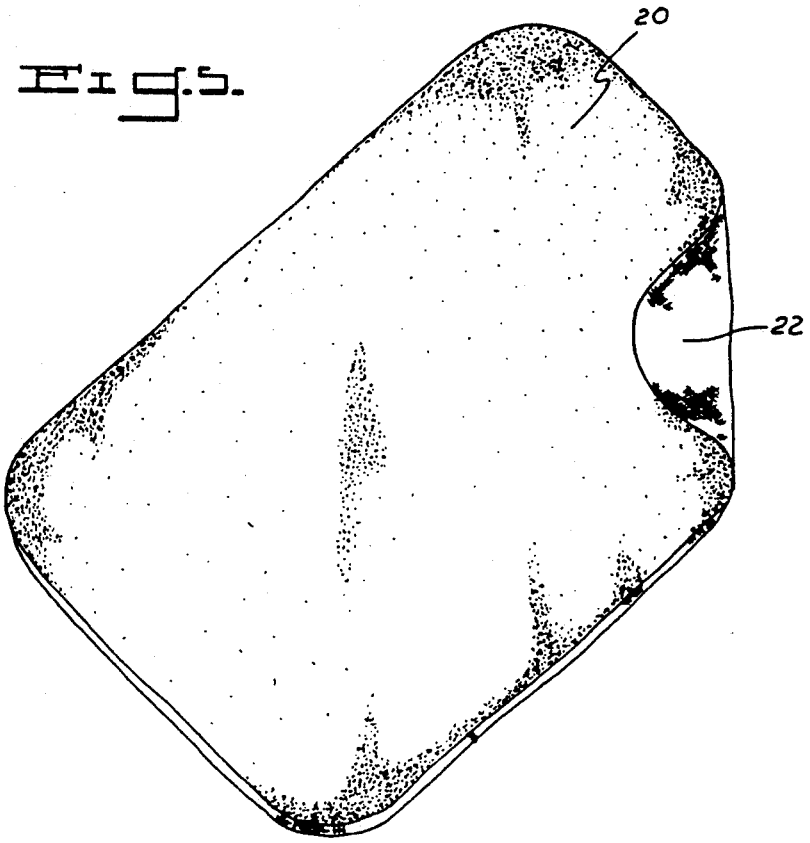
FIG. 5 is a perspective view showing the opposite side of the extension shown in FIG. 4.
Figure 4:
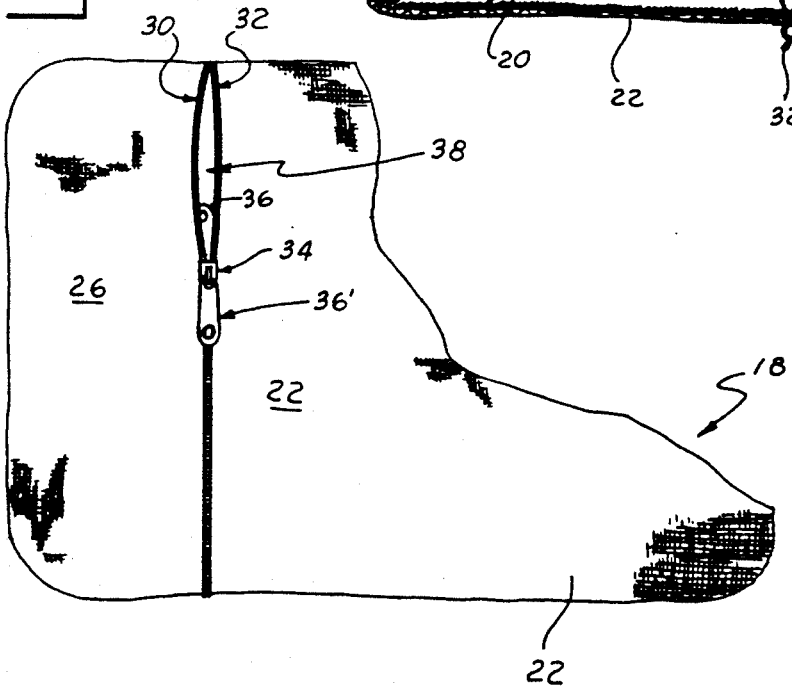
FIG. 4 is perspective view showing the pouch and fabric extension in an inside-out position from that of FIG. 2.

Referring now to FIGS. 4 and 5, the pouch 14 is shown turned inside-out to form a pocket 38 which can be completely closed without first having to roll-up extension 18. In this configuration, zipper portions 30 and 32 may be fastened together to provide a simple mat or pad to sit on at concerts, sporting events, hiking trips or the like. Still alternatively, the article may be placed under an infant when changing a diaper and the pocket 38 may be used to store new or used diapers or other baby type products. Of course, the article can also be used as a face towel when one is traveling and no suitable towels are available. The above list are only a few of the many uses for which the article may be used. in its broadest sense, pocket 38 provides a catch-all for any variety of items from a wet diaper or swim suit to toilet articles or other small accessories that a traveler may wish to have with him or her on a trip. After pocket 38 is closed, the article may be simply rolled-up for compact storage or carrying about.

As should now be appreciated, the uses of this invention are limited only by the imagination of the user, and as such, the foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed:

1. An article of manufacture comprising a pouch having a first closed end portion, first and second closed side portions and a second end portion having a length which spans the distance between said closed side portions and which can be selectively opened and closed, a textile extension integral to said pouch and adapted to be disposed within said pouch and to be extended outwardly a substantial distance therefrom, a first fastener member disposed along said length of said second end portion, and a second fastener member disposed on said extension and substantially parallel to and interengageable with said first fastener member to open and close said second end portion.

2. The article of manufacture as claimed in claim 1, wherein said pouch may be used in a first reversible position where said first and second fastener members may be engaged with said extension disposed within said pouch and a second reversible position where said first and second fastener members may be engaged with said extension extending outwardly of said pouch.

3. The article of manufacture as claimed in claim 2, wherein said closed end portion, said closed side portions and said extension each consist of a first layer of a substantially water absorbent material and a second layer of a substantially moisture impervious material superposed in generally parallel and contiguous relationship.

4. The article of manufacture as claimed in claim 3, wherein said water absorbent material is made from terry cloth and said moisture impervious material is made from nylon.

5. The article of manufacture as claimed in claim 3, wherein when said pouch is in said first reversible position, said water absorbent material of said first closed side portion and said moisture impervious material of said second closed side portion face outwardly of said pouch.

6. The article of manufacture as claimed in claim 3, wherein when said pouch is in said second reversible position, said water absorbent material of said second closed side portion and said water absorbent material of said extension member form a continuous and uninterrupted outside planar surface.

7. The article of manufacture as claimed in claim 3, wherein when said pouch is in said second reversible position, said moisture impervious material of said first closed side portion and said moisture impervious material of said extension member face outwardly and generally coplanar.

8. The article of manufacture as claimed in claim 1, wherein said first and second fastener members comprise a zipper tape portion.

9. The article of manufacture as claimed in claim 1 further comprising a cord member attached to said extension and adapted so that said extension and pouch may be used as a bib.

* * * * *